US006507725B1

(12) United States Patent
Adams et al.

(10) Patent No.: US 6,507,725 B1
(45) Date of Patent: Jan. 14, 2003

(54) SENSOR AND ASSOCIATED METHOD

(75) Inventors: Jerry F. Adams, Waterport, NY (US); David B. Montfort, Webster, NY (US); John R. Falvo, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/932,366

(22) Filed: Aug. 17, 2001

(51) Int. Cl.[7] ..... G03G 15/16
(52) U.S. Cl. ..... 399/388; 399/319; 310/312
(58) Field of Search ..... 371/258; 399/8, 399/18, 21, 22, 319, 388; 310/312, 320, 321, 322

(56) References Cited

U.S. PATENT DOCUMENTS 3,479,026 A 11/1969 Plummer et al.
3,603,680 A 9/1971 Barion
4,066,969 A 1/1978 Pearce et al.
4,513,404 A 4/1985 Huggins
5,075,543 A * 12/1991 Courtney ..... 250/223
5,282,005 A 1/1994 Nowak et al.
5,329,341 A 7/1994 Nowak et al.
5,357,324 A 10/1994 Montfort
5,512,989 A 4/1996 Montfort
5,512,990 A 4/1996 Friel et al.
5,512,991 A 4/1996 Montfort
5,515,148 A 5/1996 Montfort
6,157,804 A 12/2000 Richmond et al.

* cited by examiner

*Primary Examiner*—Hoang Ngo
(74) *Attorney, Agent, or Firm*—Maginot, Moore & Bowman

(57) ABSTRACT

A sensor and associated method is disclosed for detecting presence of a sheet which is being advanced on a photoreceptor of an electrophotographic printing device. The sensor includes a vibratory member which is configured to be positioned in contact with the photoreceptor. The sensor further includes a drive circuit operable to generate an input signal on a signal line which is coupled to the vibratory member. In addition, the sensor includes a sensing circuit operable to (i) determine if a current level of the input signal falls below a threshold value, and (ii) generate a control signal in response thereto. The control signal may be used to stop advancement of the photoreceptor such as in the case where the control signal indicates that the sheet is improperly being advanced on the photoreceptor such as into a cleaning station. Alternatively, the control signal may be used to commence operation of a machine component such as in the case where the control signal indicates that the sheet has advanced to a particular position along the path of advancement of the photoreceptor.

17 Claims, 10 Drawing Sheets

SENSOR AND ASSOCIATED METHOD

BACKGROUND OF THE INVENTION

The present invention relates generally to a sensor, and more particularly to a sensor for detecting presence of a sheet while the sheet which is being advanced or conveyed on a photoreceptor of a xerographic device such as a photocopier, printer, or similar type device.

Sensors have heretofore been designed which are adapted to detect presence of a sheet which is being advanced or conveyed on a photoreceptor, such as when the sheet is tacked to the photoreceptor due to electrostatic forces during a xerographic printing process. Such sensors are positioned along the path of travel of the photoreceptor and function to sense the presence or absence of a sheet positioned on the photoreceptor in order to detect appropriate or inappropriate movement of the sheet within the xerographic device.

One example of the above type of sensor utilizes a light transmitter and associated detector. Movement of the sheet into the path of travel of the light generated by the light transmitter causes a difference in the amount of light being received by the light receiver. As a result, presence of the sheet may be detected.

However, there are disadvantages of a sensor which utilizes a light transmitter and associated receiver. For example, accumulation of dust and other particulate material on the light transmitter and receiver tends to inhibit proper functioning of the sensor. Moreover, a sensor which utilizes a light transmitter and associated detector may not be effective to detect the presence of a sheet which is transparent or translucent. In addition, if a photoreceptor has a patch of toner (e.g. a process control patch) positioned thereon which is a bright color such a yellow, the above type of prior art sensor may inappropriately generate a control signal indicating that a sheet is present in response to such control patch being advanced by such sensor on the photoreceptor. Further, if a sheet is being transported on the photoreceptor during a duplex printing job and the backside of the sheet has a dark color toner such as black or brown adhered thereto, the above type of prior art sensor may inappropriately generate a control signal indicating that no sheet is present on the photoreceptor since the presence of the black or brown toner on the backside of the sheet may cause such sensor not to detect the presence of the sheet.

Still another disadvantage of this type of sensor is that light generated by the light transmitter may adversely affect the electrostatic charge carried by the photoreceptor and/or the sheet being advanced thereon. Indeed, such light may dissipate the electrostatic charge on the photoreceptor and/or sheet thereby interfering with the xerographic process.

What is needed therefore is a sheet sensor which addresses one or more drawbacks of the previously designed devices. For example, what is needed is a sheet sensor which detects presence of a sheet which is being advanced or conveyed on a photoreceptor but yet does not utilize a light transmitter and receiver.

The following disclosures may be relevant to various aspects of the present invention:

U.S. Pat. No. 3,479,026
Patentee: Plummer et al.
Issued: Nov. 18, 1969
U.S. Pat. No. 3,603,680
Patentee: Barton
Issued: Sep. 17, 1971

U.S. Pat. No. 4,066,969
Patentee: Pearce et al.
Issued: Jan. 3, 1978
U.S. Pat. No. 4,513,404
Patentee: Huggins
Issued: Apr. 23, 1985

SUMMARY OF THE INVENTION

It is a feature of the present invention to provide a new and useful sheet sensor.

It is another feature of the present invention to provide an improved sheet sensor.

It is yet another feature of the present invention to provide a sheet sensor adapted to detect presence of a sheet which is being advanced or conveyed on a photoreceptor which does not utilize a light transmitter and associated receiver.

Other feature and benefits of the present invention can be discerned from the following description and accompanying drawings.

In accordance with one embodiment of the present invention, there is provided a method which includes placing a vibratory member in contact with an imaging member. The method further includes applying an input signal to the vibratory member so as to excite the vibratory member and impart vibrations to the imaging member. In addition, the method includes determining if a current level of the input signal falls below a threshold value and generating a control signal in response thereto.

Pursuant to another embodiment of the present invention, there is provided a sensor for detecting presence of a sheet which is being advanced on a photoreceptor of an electrophotographic printing device. The sensor includes a vibratory member which is configured to be positioned in contact with the photoreceptor. The sensor further includes a drive circuit operable to generate an input signal on a signal line which is coupled to the vibratory member. The sensor additionally includes a sensing circuit operable to (i) determine if a current level of the input signal falls below a threshold value, and (ii) generate a control signal in response thereto.

According to still another embodiment of the present invention, there is provided a printing machine which includes a charge retentive member configured to be advanced in a path of movement. The printing machine further includes a sensor operable to detect presence of a sheet which is being advanced on. the charge retentive member. The sensor includes (i) a vibratory member positioned in contact with the charge retentive member, (ii) a drive circuit operable to generate an input signal on a signal line which is coupled to the vibratory member, and (ii) a sensing circuit operable to monitor electrical characteristics of the input signal and generate a control signal in response to the electrical characteristics possessing a predetermined quality.

DESCRIPTION OF THE PREFERRED EMBODIMENT

Figure 1:
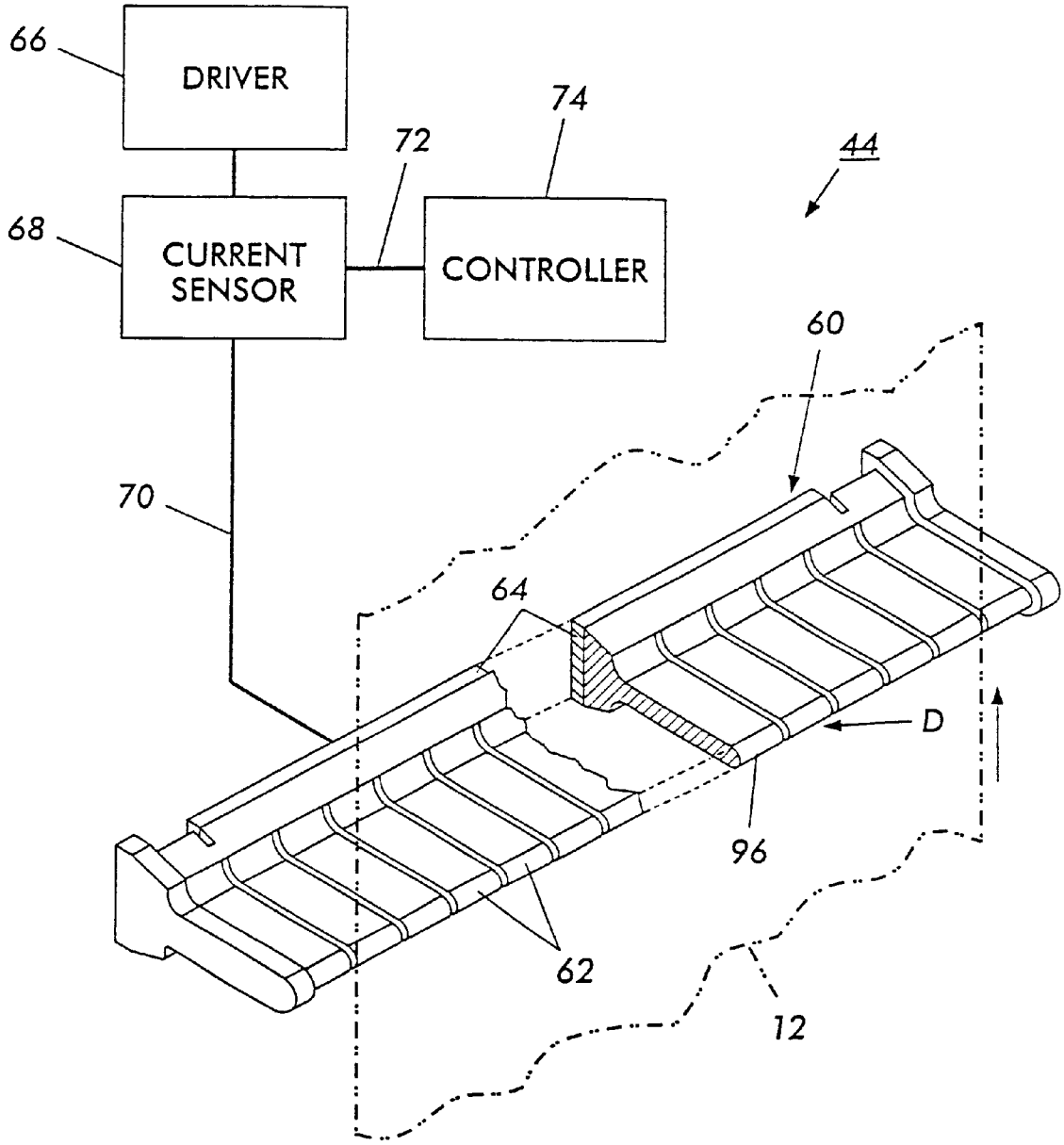
FIG. 1 is a schematic diagram of an acoustic transfer assist system that is part of the printing machine of FIG. 10 which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 10:
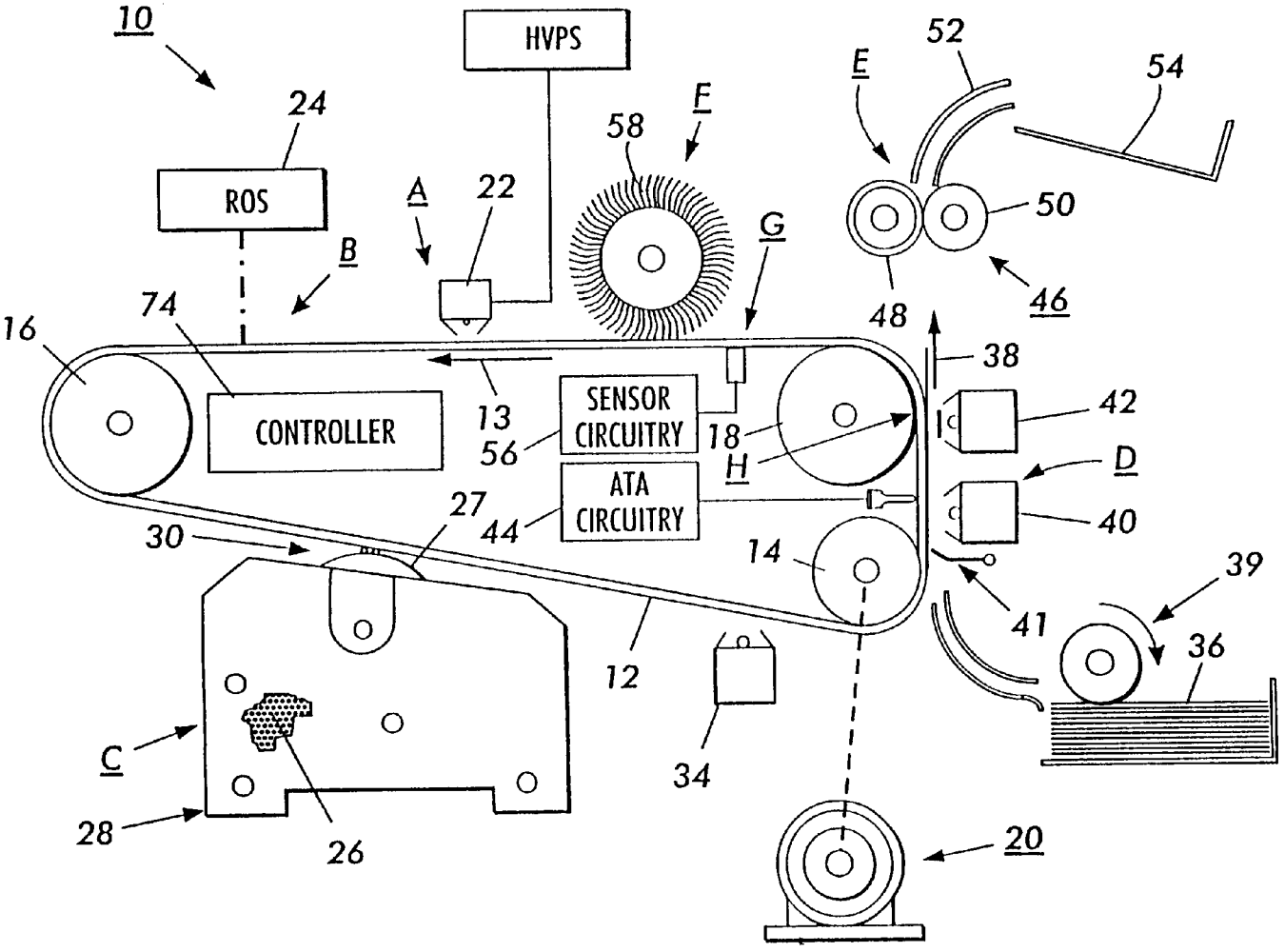
FIG. 10 is a schematic diagram of a typical printing machine environment incorporating the present invention therein.

Referring initially to FIG. 10, there is shown an illustrative electrophotographic printing machine 10 having incorporated therein the sheet sensors of the present invention. The printing machine 10 creates an image in a single pass through the machine. It should be appreciated that the present invention may be used in an electrophotographic printing machine which utilizes an image on image process to create a color image in a single pass through the machine, however, the present invention is described in the context of a printing machine which creates a single black toner image on a sheet.

The printing machine 10 uses a charge retentive member or imaging member in the form of a photoreceptor belt 12 which travels sequentially through various process stations in the direction indicated by the arrow 13. Belt travel is achieved by mounting the belt 12 about a drive roller 14 and two tension rollers 16 and 18 and then rotating the drive roller 14 via a drive motor 20.

As the photoreceptor belt 12 moves, each part of it passes through each of the subsequently described process stations. For convenience, a single section of the photoreceptor belt, referred to as the image area, is identified. The image area is the part of the photoreceptor belt which is to receive the toner powder image which, after being transferred to a substrate such as a sheet of paper, produces the final image.

As the photoreceptor belt 12 moves, the image area passes through a charging station A. A corona generating device 22 charges the image area to a relatively high and substantially uniform potential at the charging station A. The corona generating device 22 is powered by a high voltage power supply (HVPS).

After passing through the charging station A, the now charged image area passes through an exposure station B. At exposure station B, the charged image area is exposed to light which illuminates the image area with a light representation of an image. The light representation discharges some parts of the image area so as to create an electrostatic latent image. While the illustrated embodiment uses a laser based output scanning device 24 or raster output scanner (ROS) as a light source, it is to be understood that other light sources, for example an LED printbar, can also be used with the principles of the present invention. It should also be appreciated that the present invention may be practiced in a light lens machine in which an image is formed by passing light through an original document to expose the photoconductive surface.

After passing through the exposure station B, the now exposed image area passes through a development station C. The development station C deposits an image of negatively charged toner 26 onto the image area. The toner is attracted to the less negative sections of the image area and repelled by the more negative sections. The result is a toner powder image on the image area.

The development station C incorporates a donor roll 27 in a development system 28. An electrode grid 30 is electrically biased with an AC voltage relative to the donor roll 27 for the purpose of detaching toner therefrom so as to form a toner powder cloud in the gap between the donor roll 27 and the photoreceptor belt 12. Both the electrode grid 30 and the donor roll 27 are biased at a DC potential for discharge area development (DAD). The discharged photoreceptor image attracts toner particles from the toner powder cloud to form a toner powder image thereon.

Thereafter, the toner powder image is advanced past a corotron member 34 to a transfer station D. At the transfer station D, the toner powder image is transferred from the image area onto a support sheet 36 (e.g. a sheet of paper, a transparency, or any other member adapted to receive marking particles thereon). It should be understood that the sheet 36 is advanced onto the photoreceptor belt 12 by a conventional sheet feeding apparatus schematically shown by reference numeral 39. The sheet then advances through the transfer station D in the direction of arrow 38. The transfer station D includes a transfer assist blade system 41 which is operable to apply uniform contact pressure to the sheet 36 as the sheet is advanced onto the photoreceptor belt 12 by the sheet feeding apparatus 39. In particular, as the sheet is being advanced onto the photoreceptor belt 12, a transfer assist blade (not shown) of the transfer assist blade system 41 presses the sheet 36 into contact with the toner powder image on the photoreceptor belt 12 thereby substantially eliminating any spaces between the sheet 36 and the toner powder image. One transfer assist blade system which may be used with the present invention is disclosed in U.S. Pat. No. 5,300,993 issued to Vetromile, the disclosure of which is totally incorporated herein by reference in its entirety.

The transfer station D further includes a transfer corona device 40 which sprays positive ions onto the sheet 36. Also, at transfer station D, an acoustic transfer assist (ATA) system 44 is operable to impart vibrations to the photoreceptor belt 12 during operation of the corona device 40. Operation of these devices 40, 44 cause the negatively charged toner powder image to move onto the sheet 36. Positioned downstream relative to the transfer corona device 40 is a detack corona device 42 which facilitates removal of the sheet 36 from the photoreceptor belt 12.

After being advanced through the transfer station D, the sheet 36 moves onto a conveyor (not shown) which advances the sheet to a fusing station E. The fusing station E includes a fuser assembly 46 which is operable to permanently affix the transferred powder image to the sheet 36. Preferably, the fuser assembly 46 includes a heated fuser roller 48 and a backup or pressure roller 50. When the sheet 36 passes between the fuser roller 48 and the backup roller 50, the toner powder is permanently affixed to the sheet 36. After fusing, a chute 52 guides the sheet 36 to a catch tray 54 for removal by an operator.

After the sheet 36 has separated from the photoreceptor belt 12, the image area is advanced past a sheet sensor assembly 56 positioned at a location G and toward a cleaning station F. Upon arrival at the cleaning station F, residual toner particles on the image area are removed via a cleaning brush 58 located at the cleaning station F. The image area is then ready to begin a new marking cycle.

The various machine functions described above are generally managed and regulated by a controller 74 which provides electrical command signals for controlling the operations described above.

Turning now to FIG. 1, the ATA system 44 is shown in more detail. The ATA system 44 is substantially similar to the ATA system disclosed in U.S. Pat. No. 6,157,804 issued to Richmond et al., the disclosure of which is totally incorporated herein by reference in its entirety. However, one difference that exists between these two systems is that the ATA system 44 further operates as a sensor to detect presence of a sheet 36 being advanced on the photoreceptor belt 12 while the ATA system 44 is imparting vibrations to the photoreceptor belt 12. Since acoustic transfer assist systems in general are well known in the art, only some of the components of the ATA system 44 will be discussed herein in detail. Examples of some acoustic transfer assist systems are disclosed in the following U.S Patents, the disclosure of each of such patents being totally incorporated herein by reference in its entirety: U.S. Pat. No. 5,515,148 issued May 7, 1996 entitled "Resonator Assembly Including a Waveguide Member Having Inactive End Segments"; U.S. Pat. No. 5,512,991 issued Apr. 30, 1996 entitled "Resonator Assembly Having an Angularly Segmented Waveguide Member"; U.S. Pat. No. 5,512,990 issued Apr. 30, 1996 entitled "Resonating Assembly Having a Plurality of Discrete Resonator Elements"; U.S. Pat. No. 5,512,989, issued Apr. 30, 1996 entitled "Resonator Coupling Cover for use in Electrostatographic Applications"; U.S. Pat. No. 5,357,324 issued Oct. 18, 1994 entitled "Apparatus for applying Vibratory Motion to a Flexible Planar Member"; U.S. Pat. No. 5,329,341 issued Jul. 12, 1994 entitled "Optimized Vibratory Systems in Electrophotographic Devices"; and U.S. Pat. No. 5,282,005 issued Jan. 25, 1994 entitled "Cross Process Vibrational Mode Suppression in High Frequency Vibratory Energy Producing Devices for Electrophotographic Imaging".

As shown in FIG. 1, the ATA system 44 includes a horn-shaped transducer 60 having waveguide segments 62 which engage the backside (i.e. non-image side) of the photoreceptor belt 12 at the transfer station D. The transducer 60 further has a piezoelectric element 64 which is driven by a drive circuit 66. Interposed between the drive circuit 66 and the transducer 60 is a current sensor 68. The current sensor 68 is operable to detect when an input current on the signal line 70 falls below a threshold current value. In response to the input current on the signal line 70 falling below the threshold current value, the current sensor 68 generates a control signal on a signal line 72 which is fed to the controller 74. Generation of the control signal on the signal line 72 indicates that a sheet 36 is present on the photoreceptor belt 12 at a location adjacent the transducer 60 in the transfer station D.

Figure 2:
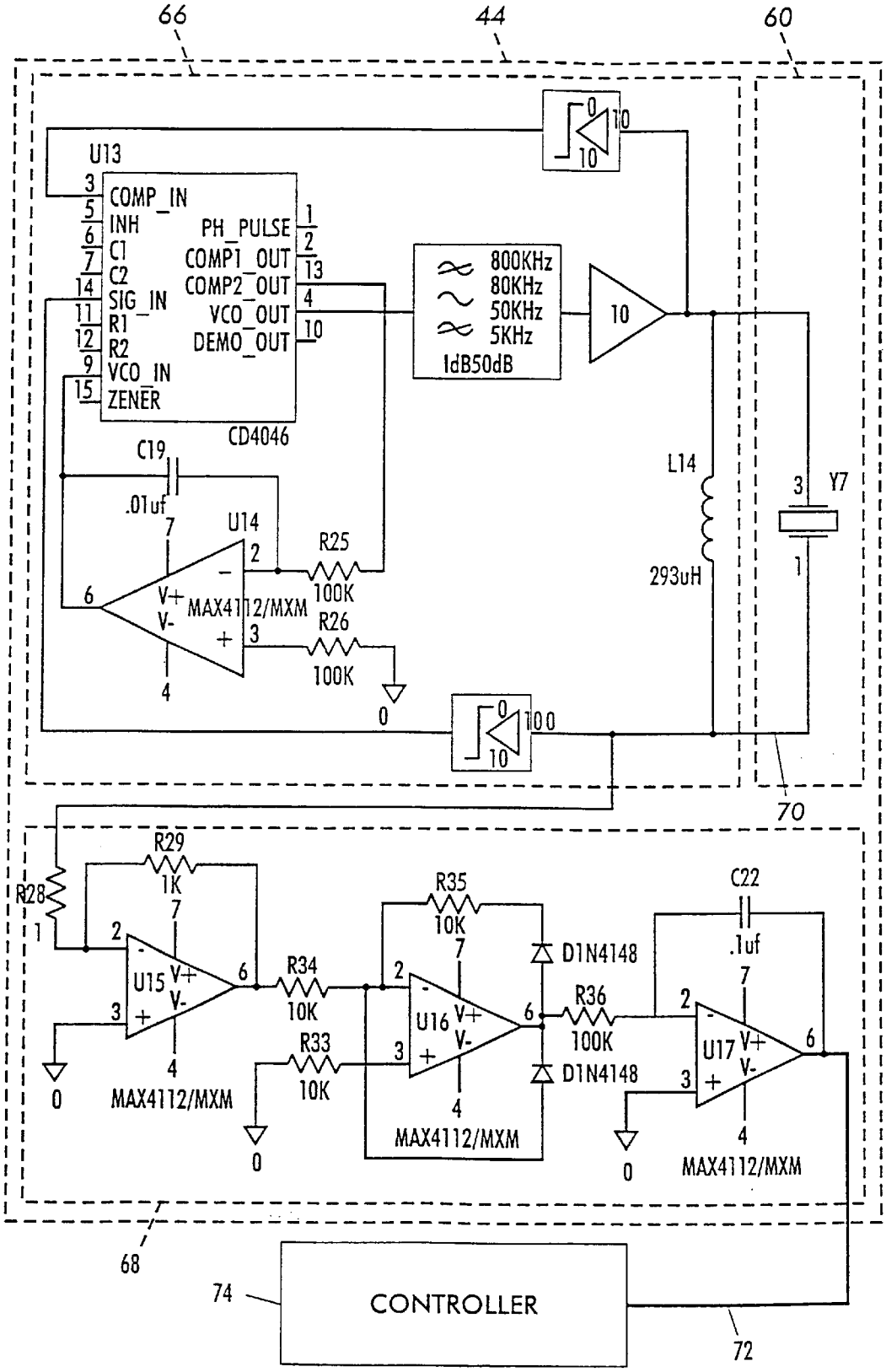
FIG. 2 is a view similar to FIG. 1 but showing an electrical schematic diagram of the drive circuit, the current sensor, and the transducer of the acoustic transfer assist system interfaced together.

An example of one drive circuit which may be used as the drive circuit 66 of the present invention is shown in FIG. 2. Moreover, an example of one current sensor which may be used as the current sensor 68 of the present invention is also shown in FIG. 2. FIG. 2 shows how such exemplary drive circuit and such exemplary current sensor are interfaced together with the transducer 60 and the controller 74.

Figure 4:
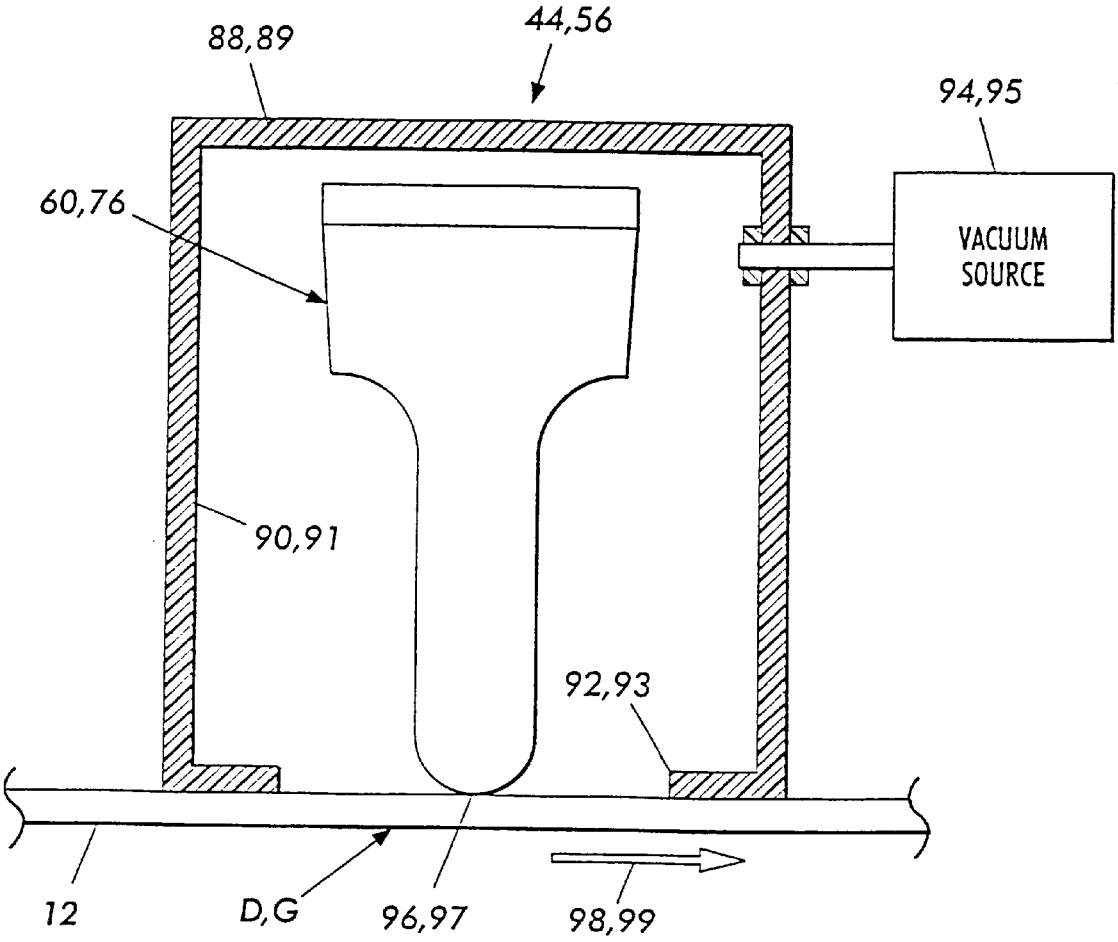
FIG. 4 is a schematic diagram of an arrangement utilized in the printing machine of FIG. 10 to enhance contact between (i) the transducer of the acoustic transfer assist system of FIG. 1 and the photoreceptor belt, and (ii) the transducer of the sheet sensor assembly of FIG. 3 and the photoreceptor belt.

It may be desirable to enhance contact between the horn-shaped transducer 60 and the backside of the photoreceptor belt 12 at the transfer station D by application of a vacuum. In particular, as shown in FIG. 4, the ATA assembly 44 may include a housing 88 defining a cavity 90 in which the transducer 60 is located. The housing 88 further defines an opening 92 in the housing which is juxtaposed to the photoreceptor belt 12 at the transfer station D. A vacuum source 94 is positioned in fluid communication with the cavity 90. The vacuum source 94 is operable to generate a vacuum of −50.0 mmHg within the cavity. When the vacuum source 94 is operated so as to generate a vacuum in the cavity 90, the photoreceptor belt 12 is drawn toward the opening 92 thereby forcing a lower tip 96 of the transducer 60 into continuous engagement with the photoreceptor belt 12 during advancement of the belt 12 in the direction of arrow 98.

Figure 3:
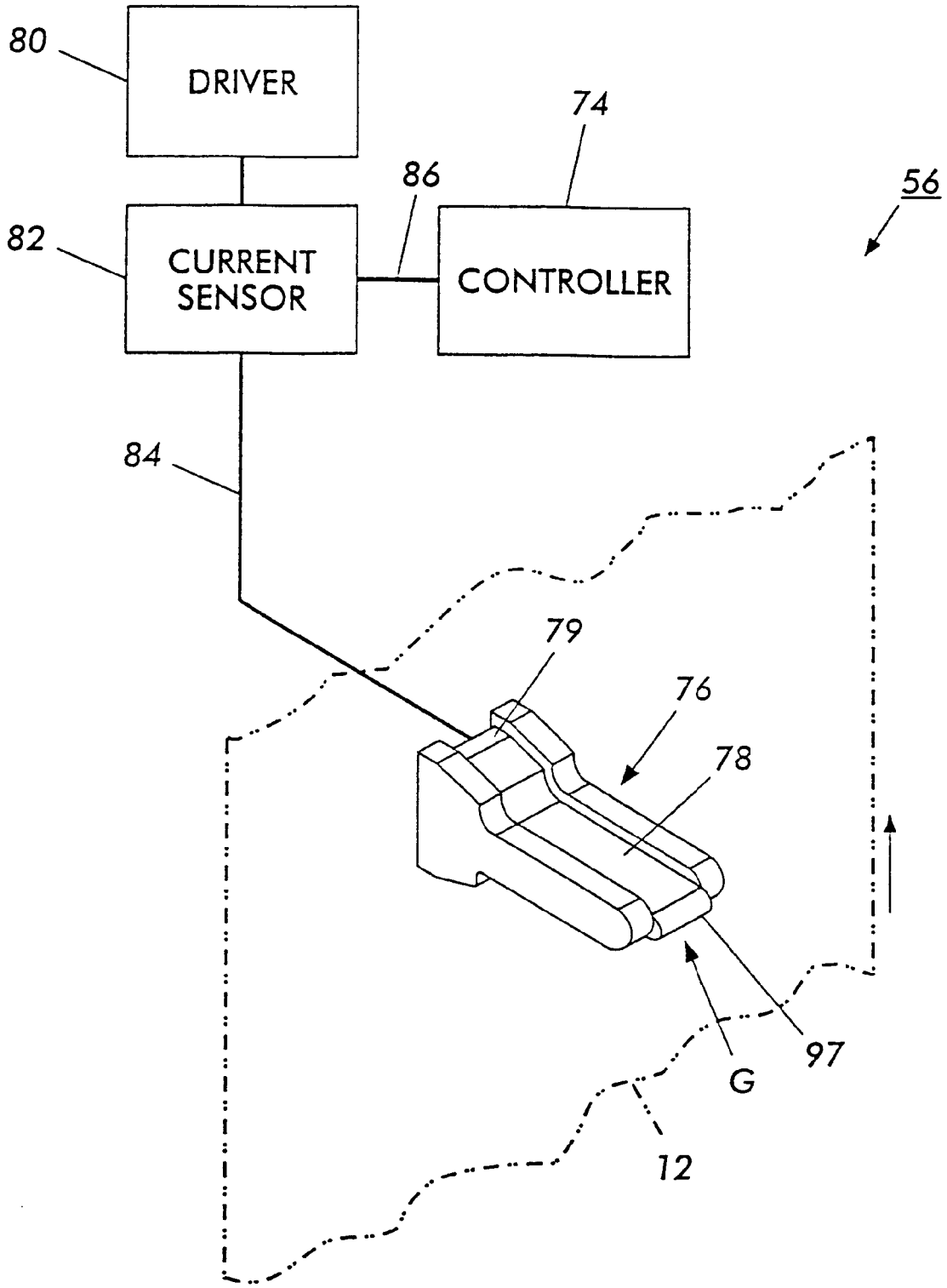
FIG. 3 is a schematic diagram of a sheet sensor assembly that is part of the printing machine of FIG. 10 which incorporates the features of the present invention therein.

Referring now to FIG. 3, the sheet sensor assembly 56 is shown in more detail. The sheet sensor assembly 56 is somewhat similar to the ATA system 44, however, the sheet sensor assembly 56 includes a horn-shaped transducer 76 which may possess a number of waveguide segments 78 which is less than the number of waveguide segments 62 possessed by the horn-shaped transducer 60. For example, the number of waveguide segments 78 may be one (i.e. "1") as shown in FIG. 3. Alternatively, the number of waveguide segments 78 may be a number greater than one such as two (i.e. "2") or three (i.e. "3"). The transducer 76 of the sheet sensor assembly 56 does not necessarily require as many waveguide segments 78 because the transducer 76 need not span the entire width of the photoreceptor belt 12. Rather, it only need detect presence of a sheet 36 tacked to the photoreceptor belt 12 at any widthwise location on the photoreceptor belt 12. In contrast, it is beneficial for the transducer 60 of the ATA system 44 to span the entire width of the photoreceptor belt 12 since imparting vibrations to the photoreceptor belt 12 across its entire width facilitates transfer of the negatively charged toner powder image (which may itself substantially span the entire width of the belt 12) from the photoreceptor belt 12 to the sheet 36.

The waveguide segment 78 of the horn-shaped transducer 76 engages the backside (i.e. non-image side) of the photoreceptor belt 12 at a location G (see e.g. FIG. 10). The transducer 76 further has a piezoelectric element 79 which is driven by a drive circuit 80. Interposed between the drive circuit 80 and the transducer 76 is a current sensor 82. The current sensor 82 is operable to detect when an input current on the signal line 84 falls below a threshold current value. In response to the input current on the signal line 84 falling below the threshold current value, the current sensor 82 generates a control signal on a signal line 86 which is fed to the controller 74. Generation of the control signal on the signal line 84 indicates that the sheet 36 is being advanced or conveyed on the photoreceptor belt 12 at a location adjacent the transducer 76 at the location G.

Figure 5:
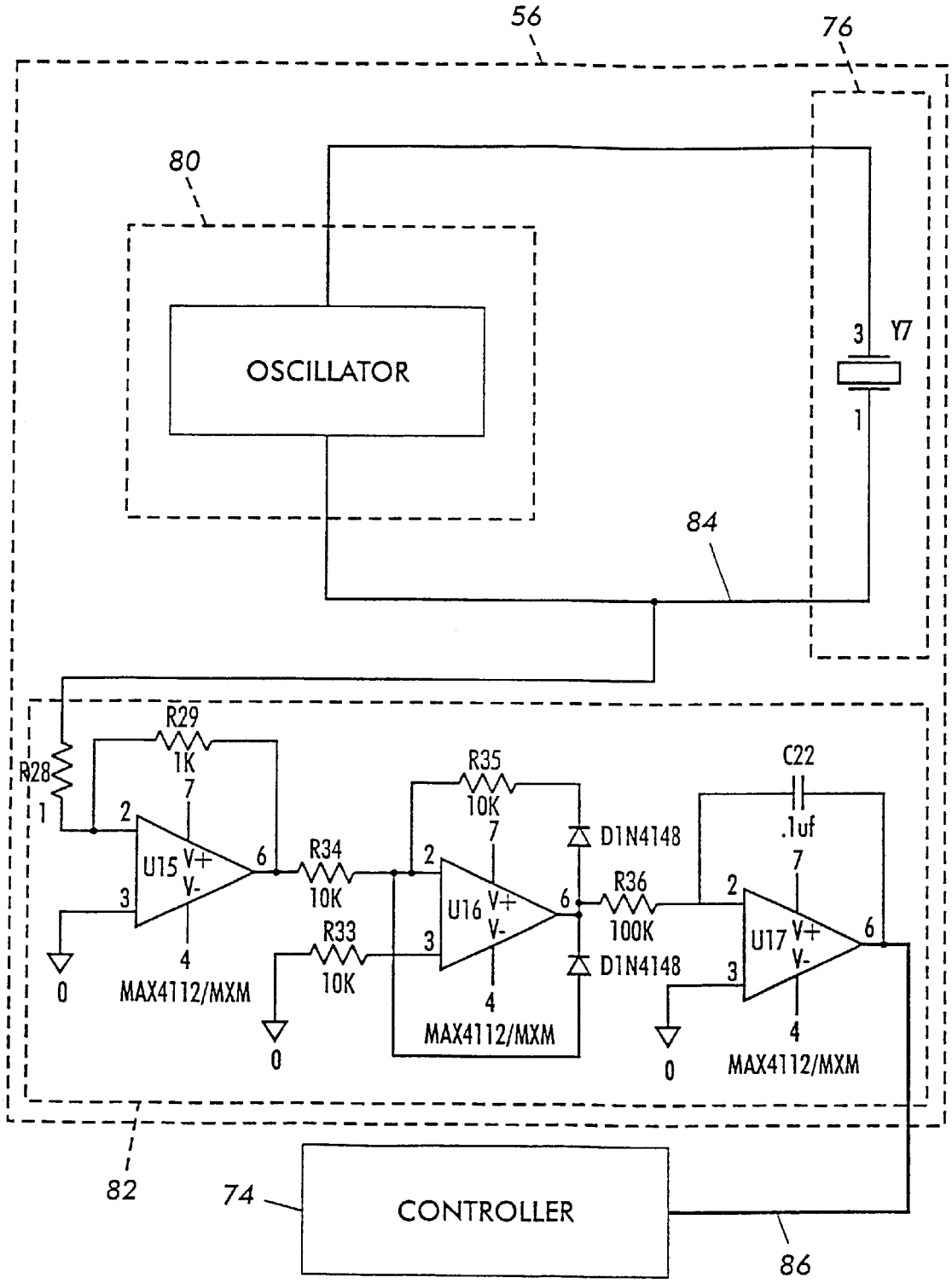
FIG. 5 is a view similar to FIG. 3 but showing an electrical schematic diagram of the drive circuit, the current sensor, and the transducer of the sheet sensor assembly interfaced together.

An example of one drive circuit which may be used as the drive circuit 80 of the present invention is shown in FIG. 5. Such exemplary driver circuit includes a power oscillator operable to generate an input signal which is effective to drive the piezoelectric device in a manner such that it converts electrical signals into mechanical energy. Such power oscillators are well known to those skilled in the art. Moreover, an example of one current sensor which may be used as the current sensor 82 of the present invention is also shown in FIG. 5. FIG. 5 shows how such exemplary drive circuit and such exemplary current sensor are interfaced together with the transducer 76 and the controller 74.

It may also be desirable to enhance contact between the horn-shaped transducer 76 and the backside of the photoreceptor belt 12 at the location G by application of a vacuum. In particular, referring again to FIG. 4, the sensor assembly 56 may include a housing 89 defining a cavity 91 in which the transducer 76 is located. The housing 89 further defines an opening 93 in the housing which is juxtaposed to the photoreceptor belt 12 at the location G. A vacuum source 95 is positioned in fluid communication with the cavity 91. The vacuum source 95 is operable to generate a vacuum of -50.0 mmHg within the cavity. When the vacuum source is operated so as to generate a vacuum in the cavity 91, the photoreceptor belt 12 is drawn toward the opening 93 thereby forcing a lower tip 97 of the transducer 76 into continued engagement with the photoreceptor belt 12 during advancement of the belt 12 in the direction of arrow 99.

Figure 6:
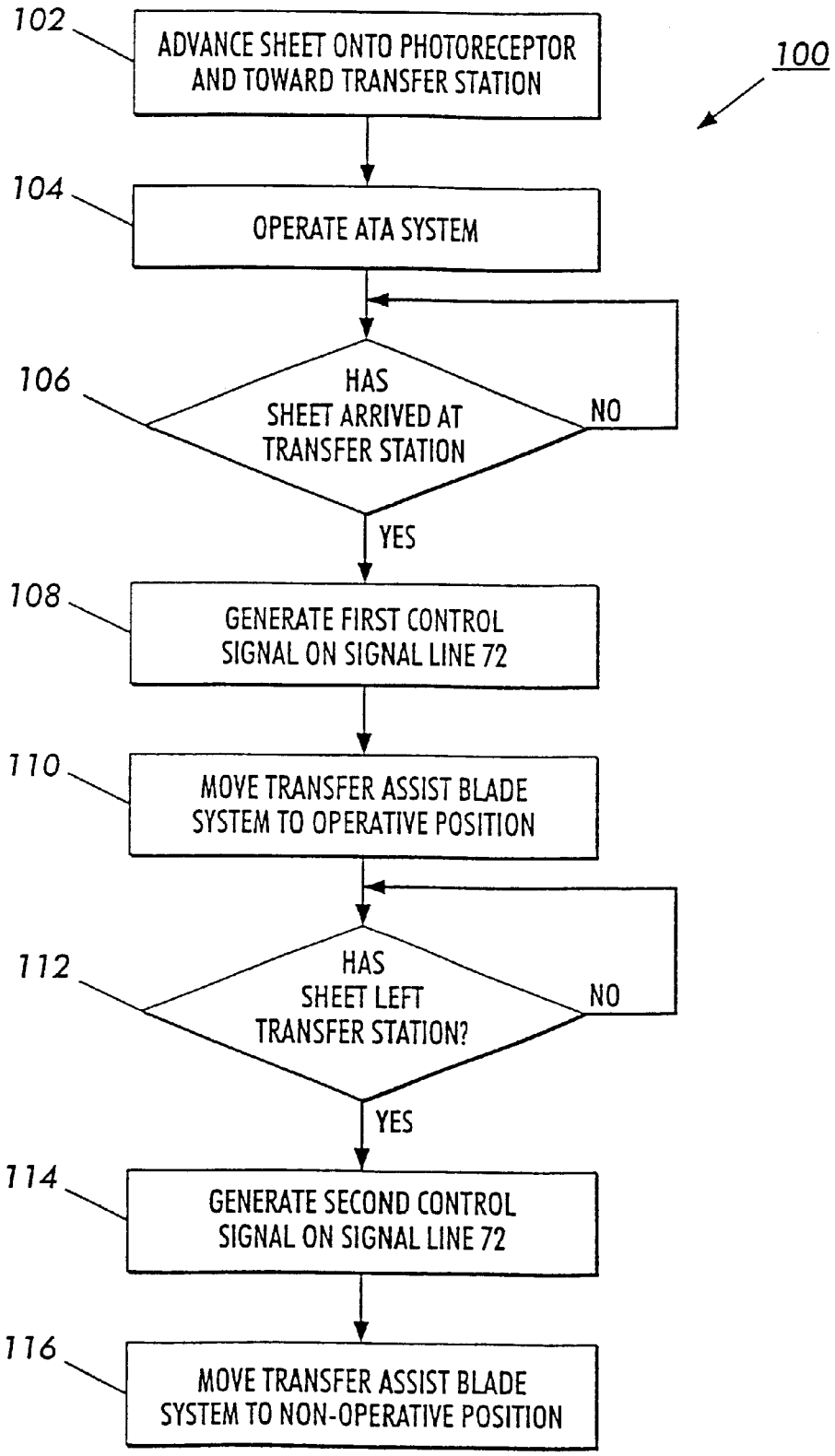
FIG. 6 is a flow chart depicting operation of the ATA system of FIG. 1 and various other components of the printing machine of FIG. 10 as a sheet is advanced through the transfer station D in accordance with one embodiment of the present invention.

FIG. 6 shows a flow chart 100 depicting operation of the ATA system 44 and various other components of the printing machine 10 as the sheet 36 is advanced through the transfer station D. Initially, at 102, one sheet 36 is advanced onto the photoreceptor belt 12 and toward the transfer station D. With continued advancement of the sheet 36 toward the transfer station D, the ATA system 44 is operating at 104 so as to impart vibrations to the photoreceptor belt 12. At 106, the ATA system 44 is operated to detect whether the sheet 36 has arrived at the transfer station D. If no sheet has been detected, the ATA system 44 continues to monitor for the arrival of the sheet 36 at the transfer station D. Once the ATA system 44 detects that the sheet 36 has arrived at the transfer station D, then the ATA system at 108 generates a first control signal on the signal line 72. The controller 74 which receives the first control signal may utilize such control signal to initiate a machine function based on knowledge of the location of the sheet 36 within the printing machine. For example, the controller may generate a command signal to move the blade system 41 to its operative position in response to receipt of the command signal generated by the ATA system 44. Thus, at 110, the transfer assist blade system 41 is moved to its operative position. When the blade system 41 is moved to its operative position, a transfer assist blade of the blade system 41 is moved in a direction toward the photoreceptor belt 12 thereby contacting the sheet 36 and pressing the sheet 36 into intimate contact with the toner powder image on the photoreceptor belt 12.

Thereafter, at 112, the ATA system 44 is operated to detect whether the sheet 36 has left the transfer station by monitoring for absence of the sheet on the photoreceptor belt 12. If the absence of the sheet has not yet been detected by the ATA system 44, such system continues to monitor for the absence of the sheet 36 at the transfer station D. Once the ATA system 44 detects that the sheet 36 has left the transfer station D, then the ATA system at 114 generates a second control signal on the signal line 72. The controller 74 receives the second control signal and utilizes such control signal to initiate another machine function based on knowledge that the sheet 36 has left the transfer station D. In this case, the controller 74 generates another command signal which is used to trigger movement of the blade system 41 to its non-operative position. In particular, at 116, when the blade system 41 is moved to its non-operative position, the transfer assist blade of the blade system 41 is moved in a direction away from the photoreceptor belt 12 so as to position the transfer assist blade at a position spaced apart from the photoreceptor belt 12.

Figure 7A:
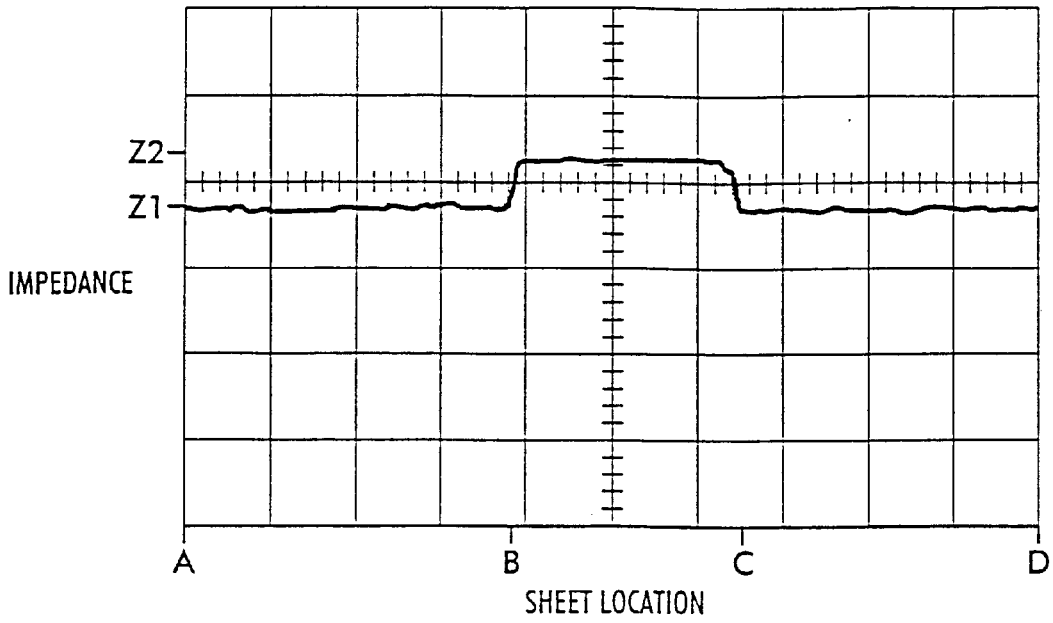
FIG. 7A is a graph which shows the impedance level of the piezoelectric device of the ATA system of FIG. 1 as a sheet approaches, enters and then subsequently exits the transfer station.
Figure 7B:
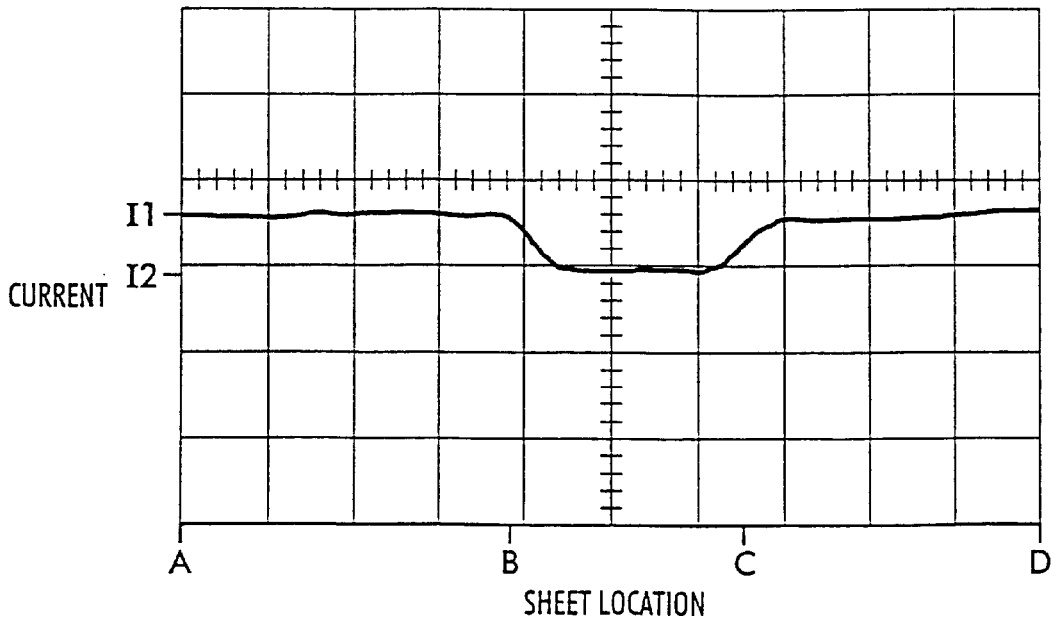
FIG. 7B is a graph which shows the current level on an output signal line of the current sensor of the ATA system of FIG. 1 as the sheet approaches, enters and then subsequently exits the transfer station.

FIG. 7A is a graph which shows the impedance level of the piezoelectric device 64 as the sheet 36 approaches, travels through, armed then subsequently exits and travels away from the transfer station D. FIG. 7B is a graph which shows the current level on the signal line 70 for the same period of travel of the sheet 36 as shown in FIG. 7A. Note that during travel between points A and B depicted in FIGS. 7A and 7B, the sheet is approaching the transfer station D. Then, during travel between points B and C, the sheet is traveling through the transfer station D. Thereafter, during travel between points C and D, the sheet is advancing away from the transfer station D.

The piezoelectric device 64 is driven by the drive circuit 66 at a constant voltage at its resonant frequency as the sheet 36 approaches, enters and then subsequently exits the transfer station D. With no sheet being located at the tip 96 of the waveguide segments 62 of the transducer 60, the impedance level of the piezoelectric device 64 is relatively low. In particular, as the sheet is approaching the transfer station D as depicted in FIG. 7A between points A and B, the impedance level of the piezoelectric device 64 remains relatively low at a value Z1. For example, the value Z1 may be 75 Ohms. With the impedance level remaining relatively constant at the value Z1, the current level on the signal line 70 remains relatively high at a value 11 as depicted in FIG. 7B. For example, the value 11 may be 130 mA. Then, as the sheet arrives at or near point B, the impedance level begins to rise to a relatively high value Z2 as depicted in FIG. 7A. For example, the value Z2 may be 130 Ohms. As a result of this rise in the impedance level, the current level on the signal line 70 begins to fall to a relatively low level at a value 12 as depicted in FIG. 7B. For example, the value 12 may be 75 mA. The impedance level remains at this increased value as the sheet continues to travel from approximately point B to approximately point C. Also, during this period of travel, the current level on the signal line 70 remains at this relatively this low level. Then, as the sheet arrives at or near point C, the impedance level begins to fall back to the relatively low value Z1 as depicted in FIG. 7A. As a result of this fall in the impedance level, the current level on the signal line 70 begins to rise back to the relatively high level at the value 11 as depicted in FIG. 7B. Thereafter, the impedance level remains at this relatively low value as the sheet continues to travel from approximately point C to approximately point D. Also, during this period of travel, the current level on the signal line 70 remains at this relatively high level.

It should be appreciated that the sensor circuit 68 is operable to detect when the current level on the signal line 70 falls below a predetermined threshold level and generate the first control signal on the signal line 72. The predetermined threshold level may be set to be a value less than the value 11 but greater than the value 12. For example, the predetermined threshold level may be set to be 100 mA.

Moreover, it should be appreciated that sensor circuit 68 is further operable to detect when the current level on the signal line 70 increases above the predetermined threshold level and generate the second control signal on the signal line 72.

Figure 8:
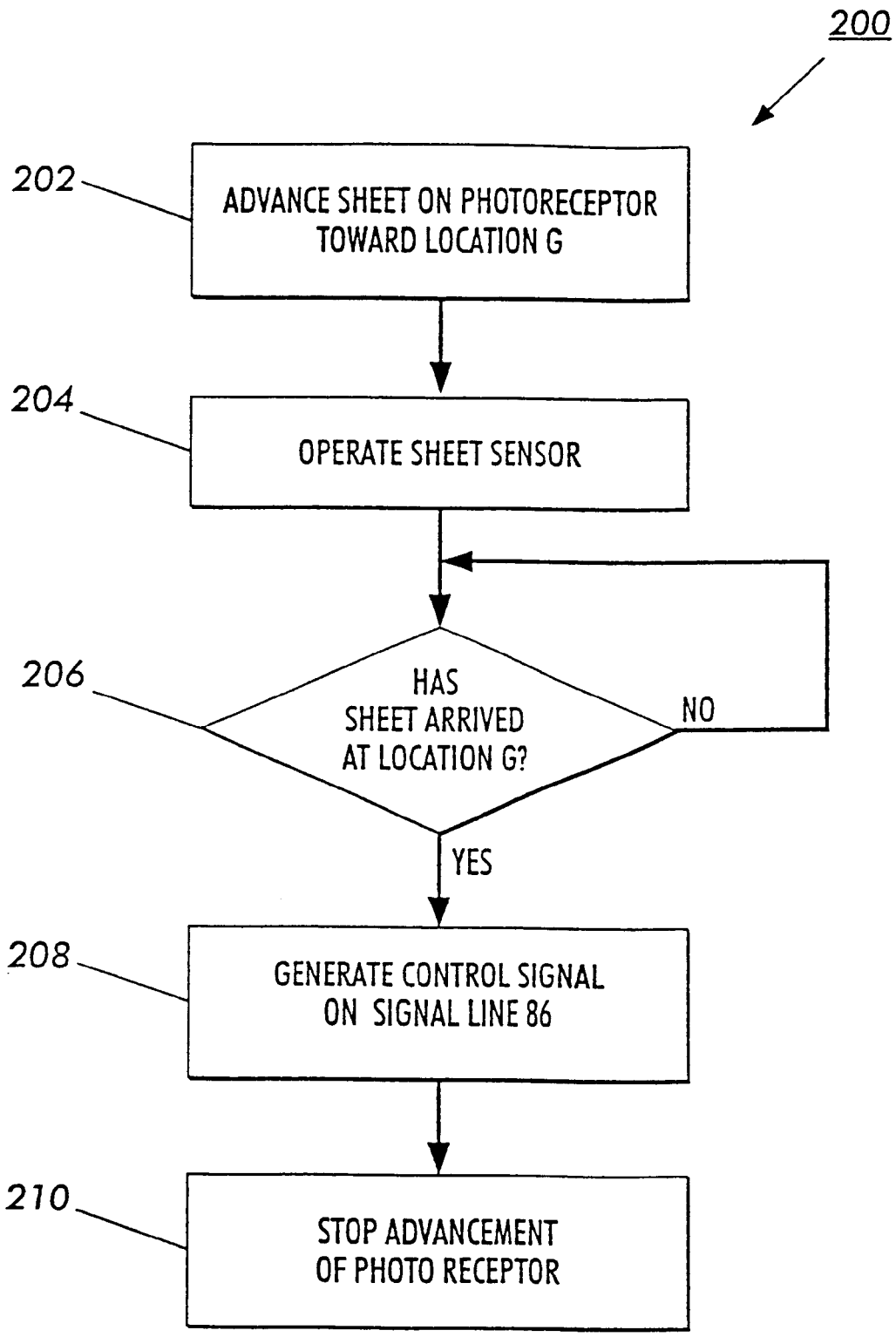
FIG. 8 is a flow chart depicting operation of the sheet sensor assembly of FIG. 3 and various other components of the printing machine of FIG. 10 as a sheet is advanced toward and arrives at a location G which is adjacent to the sheet sensing assembly in accordance with another embodiment of the present inventions.

FIG. 8 shows a flow chart 200 depicting operation of the sheet sensor assembly 56 and various other components of the printing machine 10 as the sheet 36 approaches and arrives at the location G. Initially, at 202, the sheet 36 is advanced on the photoreceptor belt 12 past the tension roller 18 and toward the location G. Such an event occurs when the sheet fails to be stripped from the photoreceptor belt 12 for further processing at the fusing station E. Continued advancement of the sheet 36 past the location G and into the cleaning station F would potentially cause substantial damage to the cleaning station F. Accordingly, it is desirable to stop advancement of the photoreceptor belt 12 upon detection of the sheet 36 at the location G.

While the sheet is being advanced toward the location G, the sensor assembly 56 is operating at 204 so as to impart vibrations to the photoreceptor belt 12. At 206, the sensor assembly 56 is operated to detect whether the sheet 36 has arrived at the location G. If no sheet has been detected at the location G, the sensor assembly 56 continues to monitor for the arrival of the sheet 36 at the location G. Once the sensor assembly 56 detects that the sheet 36 has arrived at the location G, then the sensor assembly at 208 generates a control signal on the signal line 86. The controller 74 which receives the control signal utilizes the control signal to stop advancement of the photoreceptor belt 12. In particular, upon receipt of the control signal on the signal line 86, the controller generates a command signal to deactivate the drive motor 20 thereby stopping movement of the photoreceptor belt 12. Thus, at 210, the photoreceptor belt 12 is stopped from further advancement thereby preventing the sheet 36 from being advanced into the cleaning station F. Thus, damage to the cleaning station F is avoided.

It should be appreciated the current sensor 82 operates in substantially the same manner as the current sensor 68 to detect when the current level on the signal line 86 falls below a predetermined threshold level and generate a control signal on the signal line 86 in response thereto. Thus, a detailed discussion of the rise in the impedance level of the piezoelectric device 79, and the corresponding drop in the current level on the signal line 84, as the sheet approaches and then arrives at a location adjacent to the transducer 76 will not be undertaken. One skilled in the art will readily understand the details of the operation of the sensor assembly 56 by reference to FIGS. 7A and 7B and the corresponding discussion herein. However, since the electrical requirements of the sensor 56 may be different than the electrical requirements of the ATA system 44, the values Z1, Z2, 11, 12, and the predetermined threshold level associated with the sensor 56 may be different from such values and level associated with the ATA system 44. For example, the values Z1, Z2, I1, I2, and the predetermined threshold level associated with the sensor 56 may be 500 Ohms, 1000 Ohms, 10.0 mA, 5.0 mA, and 7.5 mA, respectively.

While the piezoelectric devices 64, 79 are disclosed as being the preferred devices are which utilized in embodiments. of the present invention to receive electrical signals and convert them into mechanical forces, the present invention may use other devices in place of the piezoelectric devices 64, 79 to perform such function. One alternative device which may be used in the present invention for receiving electrical signals and converting them into mechanical forces is a voice coil.

Figure 9:
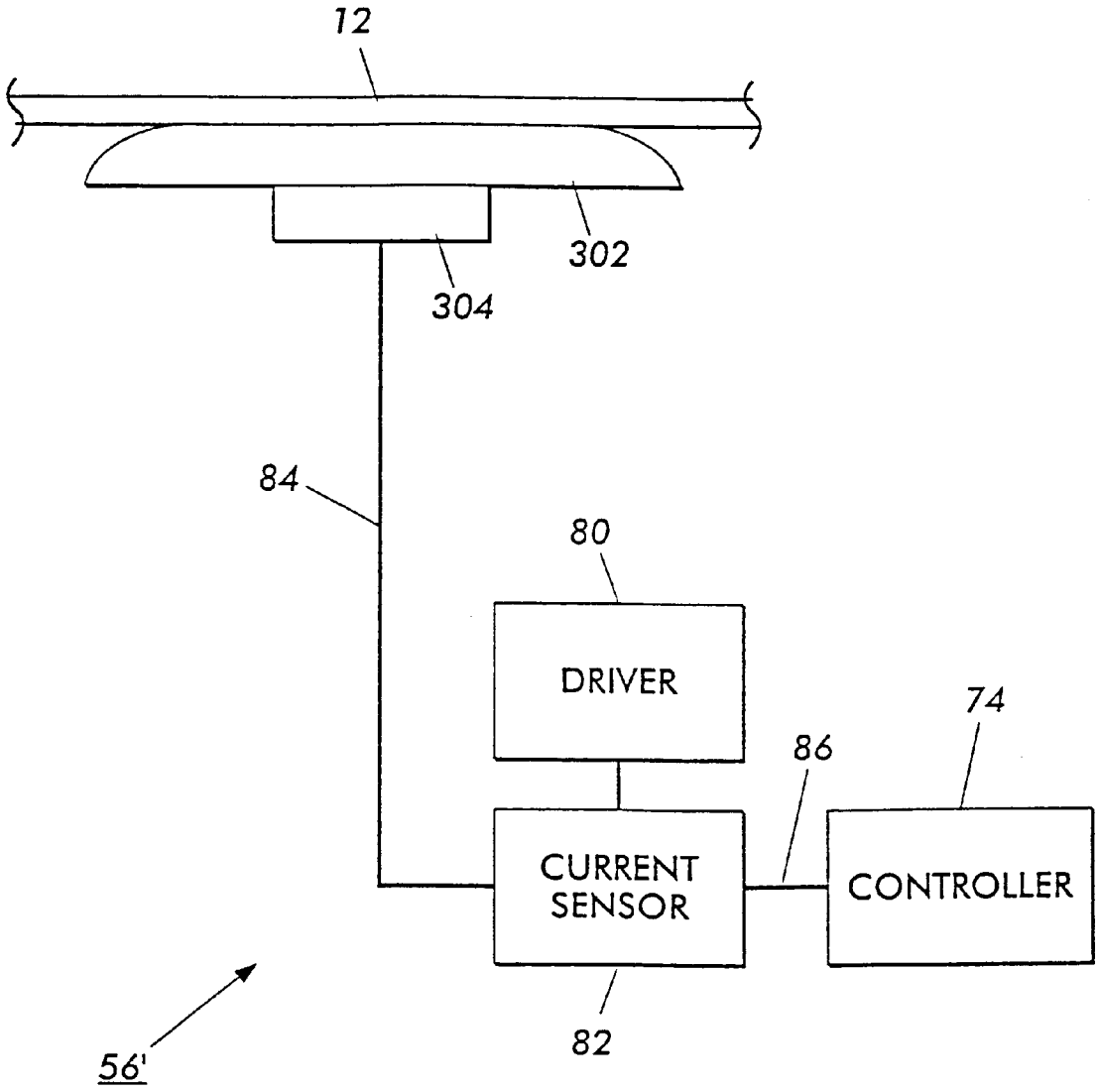
FIG. 9 is an alternative embodiment of a transducer of the sheet sensor assembly that is part of the printing machine of FIG. 10 which incorporates the features of the present invention therein.

Also, while the waveguide segments 62, 78 are disclosed as the preferred devices for receiving mechanical forces from the piezoelectric devices 64, 79 and then propagating such mechanical forces to the photoreceptor belt 12, the present invention may utilize other devices for performing this function. For example, as shown in FIG. 9, an alternative sheet sensor assembly 56' may be used in the present invention in place of sheet sensor assembly 56. The sensor assembly 56' includes a wear plate 302 which is positioned in contact with the photoreceptor belt 12. The wear plate may be made from a piece of anodized aluminum. The sensor assembly 56' further includes a piezoelectric device 304 bonded to a backside of the support plate 302 as shown in FIG. 9. The remaining components of the sensor assembly 56' are the same as that possessed by the sensor assembly 56. The sensor assembly 56' is operated in the same manner as hereinabove described with respect to the sensor assembly 56.

Moreover, while the sensor assembly 56 is described as being located at the location G for preventing advancement of the sheet 36 into the cleaning station F. The sensor assembly 56 may alternatively be located at another position adjacent to the path of travel of the photoreceptor belt 12. Or alternatively, there may be other sheet sensors 56 in addition to the sensor assembly 56 which is positioned at the location G. For example, there may be another sheet sensor 56 positioned adjacent to the photoreceptor belt 12 at a location H (see FIG. 10) in order to detect whether a sheet is present under the detack corona device 42.

Other modifications of the present invention may occur to one of ordinary skill in the art based upon a review of the present application and these modifications, including equivalents thereof, are intended to be included within the scope of the present invention.

What is claimed is:

1. A method, comprising:

placing a vibratory member in contact with an imaging member;

applying an input signal to the vibratory member so as to excite the vibratory member and impart vibrations to the imaging member;

determining if a current level of said input signal falls below a threshold value and generating a control signal in response thereto;

advancing the imaging member in a path of movement; and ceasing advancement of the imaging member in response to generation of the control signal.

2. The method of claim 1, wherein:

the vibratory member includes a piezoelectric element and a waveguide secured thereto, the waveguide is positioned in contact with the imaging member, and the piezoelectric element and the waveguide are configured such that (i) application of the input signal to the vibratory member causes the piezoelectric element to become excited so as to produce mechanical energy, and (ii) the mechanical energy is imparted from the piezoelectric element to the imaging member through the waveguide.

3. A method, comprising:

placing a vibratory member in contact with an imaging member;

applying an input signal to the vibratory member so as to excite the vibratory member and impart vibrations to the imaging member;

determining if a current level of said input signal falls below a threshold value and generating a control signal in response thereto;

advancing a transfer assist blade toward the imaging member in response to generation of the control signal.

4. A method, comprising:

placing a vibratory member in contact with an imaging member;

applying an input signal to the vibratory member so as to excite the vibratory member and impart vibrations to the imaging member;

determining if a current level of said input signal falls below a threshold value and generating a control signal in response thereto;

locating the vibratory member at a transfer station of a printing machine, and applying the input signal to the vibratory member while a sheet is being advanced on the imaging member through the transfer station.

5. The method of claim 4, wherein the printing device includes a transfer corona device operable to spray positive ions onto the sheet as the sheet is being advanced through the transfer station, further comprising:

applying the input signal to the vibratory member while the corona device is operating to spray positive ions onto the sheet as the sheet is being advanced through the transfer station.

6. A method, comprising:

placing a vibratory member in contact with an imaging member;

applying an input signal to the vibratory member so as to excite the vibratory member and impart vibrations to the imaging member;

determining if a current level of said input signal falls below a threshold value and generating a control signal in response thereto, wherein the vibratory member is positioned in a housing which defines an opening, further comprising:

generating a vacuum within the housing so as to cause the imaging member to be urged toward the vibratory member when said imaging member is juxtaposed to said opening, the vacuum being generated while the input signal is being applied to the vibratory member.

7. A sensor for detecting presence of a sheet which is being advanced on a photoreceptor of an electrophotographic printing device, comprising:

a vibratory member which is configured to be positioned in contact with the photoreceptor;

a drive circuit operable to generate an input signal on a signal line which is coupled to said vibratory member;

a sensing circuit operable to (i) determine if a current level of said input signal falls below a threshold value, and (ii) generate a control signal in response thereto;

a housing defining an opening, said vibratory member being located in said housing; and a vacuum source operable to generate a vacuum in said housing whereby said photoreceptor is drawn toward said vibratory member when said photoreceptor is juxtaposed to said opening.

8. The sensor of claim 7, wherein:

the vibratory member includes a piezoelectric element and a waveguide secured thereto, the waveguide is configured to be positioned in contact with the photoreceptor, and the piezoelectric element and the waveguide are configured such that (i) application of the input signal to the vibratory member causes the piezoelectric element to become excited so as to produce mechanical energy, and (ii) the mechanical energy is imparted from the piezoelectric element to the photoreceptor through the waveguide.

9. A printing machine, comprising:

a charge retentive member configured to be advanced in a path of movement;

a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii) a sensing circuit operable to monitor electrical characteristics of said input signal and generate a control signal in response to said electrical characteristics possessing a predetermined quality; and a corona device positioned at a transfer station and operable to spray ions onto a sheet which is being advanced on said charge retentive member, wherein said sensor is located at said transfer station.

10. The printing machine of claim 9, wherein said sensing circuit is operable to determine if a current level of said input signal falls below a threshold value and generate said control signal in response thereto.

11. The printing machine of claim 9, wherein:

the vibratory member includes a piezoelectric element and a waveguide secured thereto, the waveguide is positioned in contact with the charge retentive member, and the piezoelectric element and the waveguide are configured such that (i) application of the input signal to the vibratory member causes the piezoelectric element to become excited so as to produce mechanical energy, and (ii) the mechanical energy is imparted from the piezoelectric element to the charge retentive member through the waveguide.

12. The printing machine of claim 8, wherein said charge retentive member is a photoreceptor belt.

13. A printing machine, comprising:

a charge retentive member configured to be advanced in a path of movement;

a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii)

a sensing circuit operable to monitor electrical characteristics of said input signal and generate a control signal in response to said electrical characteristics possessing a predetermined quality;

a corona device positioned at a transfer station and operable to spray ions onto a sheet which is being advanced on said charge retentive member; and a cleaning brush positioned at a cleaning station and operable to remove toner particles from said charge retentive member, wherein said sensor is located between said transfer station and said cleaning station in said path of movement of said charge retentive member.

14. A printing machine, comprising:

a charge retentive member configured to be advanced in a path of movement; and a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii) a sensing circuit operable to monitor electrical characteristics of said input signal and generate a control signal in response to said electrical characteristics possessing a predetermined quality, wherein said sensor is operable to monitor said electrical characteristics of said input signal and generate said control signal while said input signal is being applied to said vibratory member.

15. A printing machine, comprising:

a charge retentive member configured to be advanced in a path of movement;

a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii) a sensing circuit operable to monitor electrical characteristics of said input signal and generate a control signal in response to said electrical characteristics possessing a predetermined quality;

a drive roller and a number of tension rollers; and a motor for rotating said drive roller, wherein the charge retentive member is entrained on said drive roller and said number of tension rollers, wherein actuation of said motor causes said drive roller to be rotated thereby causing said charge retentive member to be advanced in the path of movement, and wherein generation of said control signal causes said motor to be deactuated thereby ceasing movement of said charge retentive member.

16. A printing machine, comprising:

a charge retentive member configured to be advanced in a path of movement;

a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii) a sensing circuit operable to monitor electrical characteristics of said input signal and generate a control signal in response to said electrical characteristics possessing a predetermined quality;

a housing defining an opening, said vibratory member being located in said housing; and a vacuum source operable to generate a vacuum in said housing whereby said charge retentive member is drawn toward said vibratory member when said charge retentive member is juxtaposed to said opening, wherein the vacuum source is operable to generate a vacuum while said sensing circuit is monitoring said electrical characteristics of said input signal.

17. A printing machine, comprising:

a charge retentive member configured to be advanced in a path of movement;

a sensor operable to detect presence of a sheet which is being advanced on the charge retentive member, said sensor including (i) a vibratory member positioned in contact with said charge retentive member, (ii) a drive circuit operable to generate an input signal on a signal line which is coupled to said vibratory member, and (ii) a sensing circuit operable to monitor electrical characteristics of said input signal and generate a control signal in response to said electrical characteristics possessing a predetermined quality; and a transfer assist blade system which is movable between an operative position and a non-operative position, wherein generation of said control signal causes said transfer assist blade system to be moved to its operative position.

* * * * *